US005549384A

United States Patent [19]

Reynolds

[11] Patent Number: 5,549,384

[45] Date of Patent: Aug. 27, 1996

[54] MIXER WITH HELICALLY EXTENDING BLADES

[76] Inventor: Augustus T. Reynolds, 3300 Woodwardia Dr., Charlotte, N.C. 28210

[21] Appl. No.: 441,119

[22] Filed: May 15, 1995

[51] Int. Cl.[6] ..... B01F 7/24

[52] U.S. Cl. ..... 366/299; 366/143; 366/286; 366/320; 366/324

[58] Field of Search ..... 366/65, 67, 143, 366/149, 192, 197, 242, 286, 244–251, 266, 312, 316, 317, 320, 324, 328.1, 299; 416/228

[56] References Cited

U.S. PATENT DOCUMENTS

| | | | |
|---|---|---|---|
| 466,751 | 1/1892 | Gardner | 366/320 X |
| 2,247,439 | 7/1941 | Hawes | 366/266 X |
| 3,044,750 | 7/1962 | Schmitt, Jr. | 366/316 X |
| 4,049,244 | 9/1977 | Hedrich | 366/143 |
| 4,120,051 | 10/1978 | Lohning | 366/250 X |
| 4,472,063 | 9/1984 | Eickelmann | 366/320 X |
| 4,671,666 | 6/1987 | Herfeld | 366/197 |
| 4,957,373 | 9/1990 | Derksen et al. | 366/197 |
| 5,152,971 | 10/1992 | Bertrand et al. | 366/320 X |
| 5,340,210 | 8/1994 | Patel et al. | 366/160.2 X |
| 5,382,092 | 1/1995 | Okamoto et al. | 366/320 |

FOREIGN PATENT DOCUMENTS

| | | | |
|---|---|---|---|
| 3724277 | 3/1988 | Germany | 366/98 |
| 4108527 | 4/1992 | Japan | 366/320 |
| 731997 | 5/1980 | U.S.S.R. | 366/320 |

*Primary Examiner*—Charles E. Cooley
*Attorney, Agent, or Firm*—W. Thad Adams, II, P. A.

[57] ABSTRACT

A mixer includes a vessel for storing materials to be mixed. The vessel has cylindrical inner walls. A beater assembly is rotatably mounted and centrally disposed within the vessel. The beater assembly includes a drive shaft and a plurality of helically extending mixer blades operatively connected to the drive shaft for rotational movement about an axis defined by the drive shaft. The mixer blades cooperate upon a single rotation of the beater assembly to move materials residing immediately adjacent to the inner walls of the vessel inwardly towards the axis of rotation, and to move materials residing near the axis of rotation outwardly towards the inner walls of the vessel. A motor is operatively connected to the drive shaft for rotating the beater assembly relative to the vessel.

12 Claims, 4 Drawing Sheets

MIXER WITH HELICALLY EXTENDING BLADES

TECHNICAL FIELD AND BACKGROUND OF THE INVENTION

This invention relates to a mixer with helically extending blades. The invention is applicable for mixing materials of relatively thin to heavy consistencies, such as caulking, sealers, adhesives, paints, inks, vinyl products, plastisols, coatings, rubber products, waxes, and fiber products. The invention includes a vessel for storing materials, and a rotatable beater assembly located within the vessel for mixing the materials.

The present mixer operates in a unique and improved manner over mixers of the prior art by utilizing a helical mixer blade. The mixer blade extends vertically in a true helical path from the bottom of the vessel to the top of the vessel, and operates during mixing to simultaneous pump materials contained in the vessel upwardly and downwardly, and inwardly towards the center of the vessel and outwardly towards the inner walls of the vessel. As a result, the mixer provides uniform cooling and mixing of the materials, and achieves a desired mixed product with minimum time and energy. The true helical blade of the present invention defines a curve traced on the interior walls of a notional cylinder by the rotation of a point crossing its right sections at a constant oblique angle.

Mixers with blades of elliptical construction or partial helical construction have been used in the past, but have achieved less effective and efficient results. Unlike the present blade, the angle defined by the side of the prior art blade and the vessel inner walls does not remain constant as the blade extends from the bottom of the vessel to the top of the vessel. As a result, less available surface area of the blade is utilized for mixing. This effect reduces the degree of movement of the materials within the vessel during mixing.

SUMMARY OF THE INVENTION

Therefore, it is an object of the invention to provide a mixer with helically extending mixer blades.

It is another object of the invention to provide a mixer with blades which extend vertically within the vessel of the mixer in a true helical path with the angle of the side of blade remaining constant relative to the vessel inner walls.

It is another object of the invention to provide a mixer which operates during mixing to simultaneous pump materials contained in the vessel upwardly and downwardly, and inwardly towards the center of the vessel and outwardly towards the inner walls of the vessel.

It is another object of the invention to provide a mixer which provides uniform cooling and mixing of materials during operation.

It is another object of the invention to provide a mixer which achieves a desired mixed product with relatively little time and energy.

It is another object of the invention to provide a mixer for relatively large-scale industrial application.

It is another object of the invention to provide a mixer which utilizes a vessel ranging in size from between 1 quart to over 5000 gallons.

These and other objects of the present invention are achieved in the preferred embodiments disclosed below by providing a mixer. The mixer includes a vessel for storing materials to be mixed. The vessel has cylindrical inner walls.

A beater assembly is rotatably mounted and centrally disposed within the vessel. The beater assembly includes a drive shaft and a plurality of helically extending mixer blades operatively connected to the drive shaft for rotational movement about an axis defined by the drive shaft.

The mixer blades cooperate upon a single rotation of the beater assembly to move materials residing immediately adjacent to the inner walls of the vessel inwardly towards the axis of rotation, and to move materials residing near the axis of rotation outwardly towards the inner walls of the vessel. Thus, the materials in the vessel are continually turned over and transferred during mixing between a center portion of the vessel and an outer portion of the vessel for uniform mixing and cooling of the materials.

A motor means is operatively connected to the drive shaft for rotating the beater assembly relative to the vessel.

According to one preferred embodiment of the invention, a vertical lift is mounted outside of the vessel. The lift is connected to the drive shaft of the beater assembly for lowering the mixer blades into the vessel, and for lifting the mixer blades out of the vessel.

According to another preferred embodiment of the invention, the beater assembly includes an annular support hoop attached to respective top ends of the mixer blades for controlling the inward and outward deflection of the mixer blades during mixing.

According to yet another preferred embodiment of the invention, the beater assembly includes intersecting arms attached to a base of the drive shaft and to respective bottom ends of the mixer blades for rotating the mixer blades upon rotation of the drive shaft.

Preferably, the arms of the beater assembly include teeth for engaging and breaking-up the materials contained in the vessel.

According to another preferred embodiment of the invention, scrapers are attached to respective mixer blades for engaging the inner walls of the vessel to remove materials adhering to the inner walls of the vessel during mixing.

According to yet another preferred embodiment of the invention, a cooling jacket surrounds the outer walls of the vessel for cooling the materials contained in the vessel during mixing.

Preferably, the jacket includes an inlet port for receiving a cooling fluid.

According to another preferred embodiment of the invention, the vessel includes a discharge opening for discharging the materials contained in the vessel after mixing.

Preferably, a control valve is located at discharge opening for controlling the flow of materials outwardly through the discharge opening.

According to another preferred embodiment of the invention, the vessel includes a lid removably sealed to a top end of the vessel.

According to yet another preferred embodiment of the invention, a sight glass window is formed in the lid for viewing of the materials contained in the vessel during mixing.

According to yet another preferred embodiment of the invention, a vessel port is formed in the lid for receiving a second material into the vessel.

According to yet another preferred embodiment of the invention, a high-speed disperser blade is rotatably mounted within the vessel for shearing and mixing finer materials contained in the vessel.

Preferably, the motor means is a hydraulic motor.

According to another preferred embodiment of the invention, a carriage is provided for locating the vessel on a supporting surface.

Preferably, the carriage includes a plurality of wheels for transport of the vessel on the supporting surface.

According to another preferred embodiment of the invention, a helically extending mixer blade is used in combination with at least one like blade in a vessel for mixing materials contained in the vessel. The helical mixer blades are operatively connected to a drive shaft for rotational movement about an axis defined by the drive shaft. The mixer blades cooperate upon a single rotation about the axis to move materials residing immediately adjacent to an inner wall of the vessel inwardly towards the axis of rotation, and to simultaneously move materials residing near the axis of rotation outwardly towards the inner wall of the vessel. Thus, the materials in the vessel are continually transferred during mixing between a center portion of the vessel and an outer portion of the vessel for uniform mixing and cooling of the materials.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
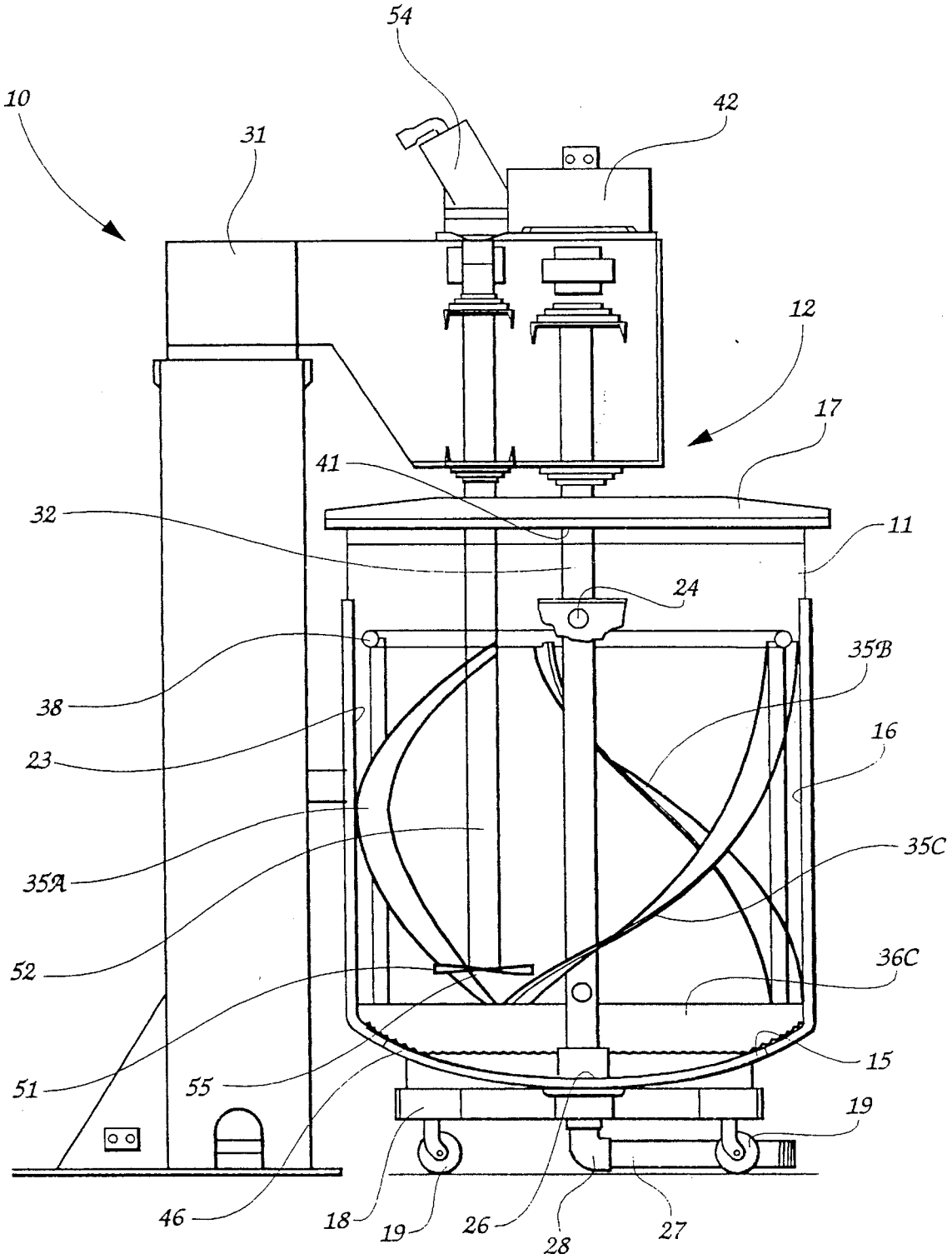
FIG. 1 is a side elevation of the mixer according to one preferred embodiment of the invention, and showing a portion of the vessel outer wall broken away to illustrate the interior elements of the mixer.

Referring now specifically to the drawings, a mixer according to the present invention is illustrated in FIG. 1 and shown generally at reference numeral 10. The mixer 10 is useful for mixing materials of relatively thin to heavy consistencies, such as caulking, sealers, adhesives, paints, inks, vinyl products, plastisols, coatings, rubber products, waxes, and fiber products. As described in detail below, the mixer 10 includes a vessel 11 for storing the materials, and a rotatable beater assembly 12 removably positioned within the vessel 11 for mixing the materials.

THE VESSEL

Figure 2:
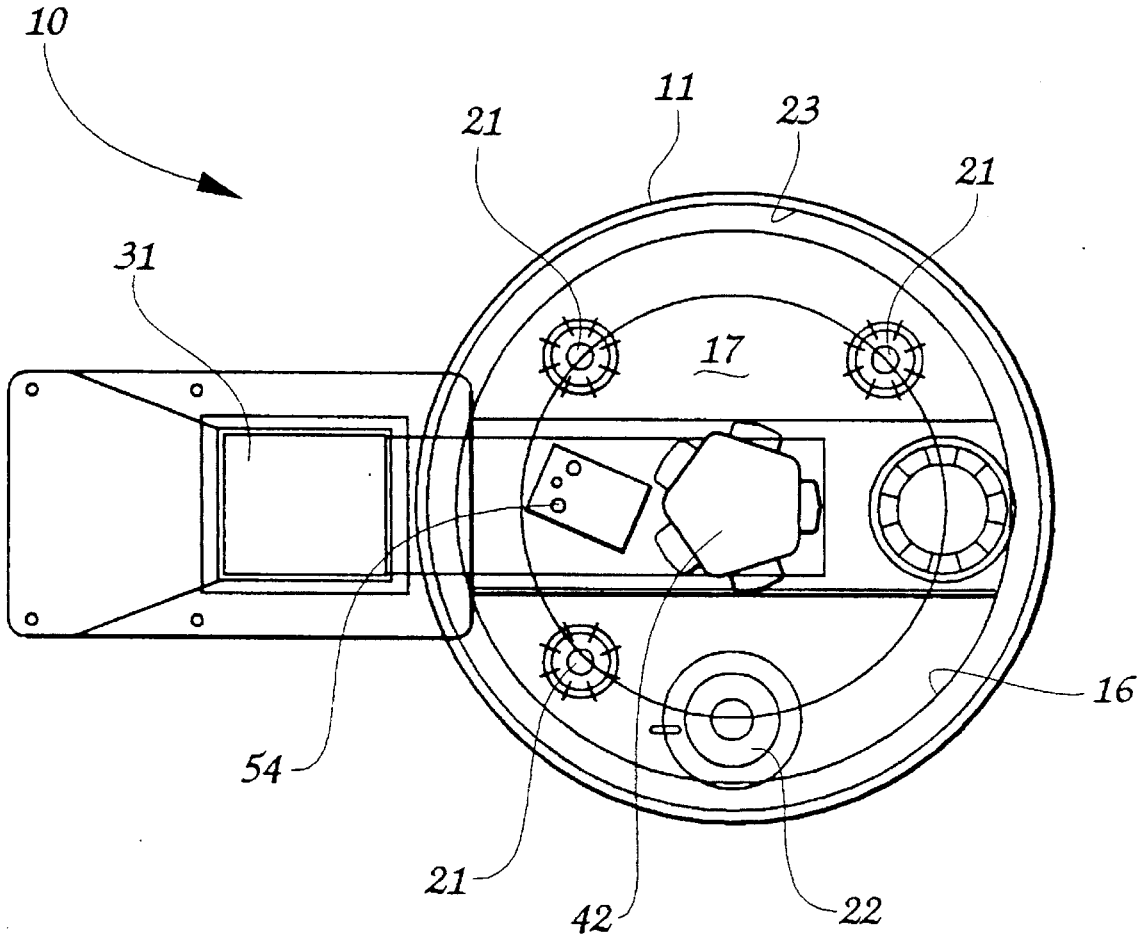
FIG. 2 is a top plan view of the mixer illustrated in FIG. 1.

Referring to FIGS. 1 and 2, the vessel 11 includes a bottom wall 15, cylindrical inner walls 16, and a lid 17, and is preferably mounted on a portable carriage 18 with caster wheels 19. According to one embodiment, the lid 17 is sealed to the vessel 11 and maintains the contents of the vessel 11 in pressurized condition during mixing. Several input ports 21 are formed in the lid 17 for inserting products into the vessel 11, such as pigments and oils. In addition, the lid 17 may include one or more sight glass windows 22 for allowing a user to view the materials during mixing.

Preferably, a standard water jacket 23 surrounds the vessel 11, and serves to cool the vessel 11 during mixing. As shown in FIG. 1, the water jacket 23 includes an inlet/outlet opening 24 for receiving and draining the water.

A drain opening 26 is formed in the bottom wall 15 of the vessel 11, and is connected to a discharge pipe 27 for discharging the materials from the vessel 11 after mixing. The discharge pipe 27 includes a control valve 28, such as a flush bottom ball valve, for controlling the flow of materials from the vessel 11.

THE BEATER ASSEMBLY 12

Figure 3:
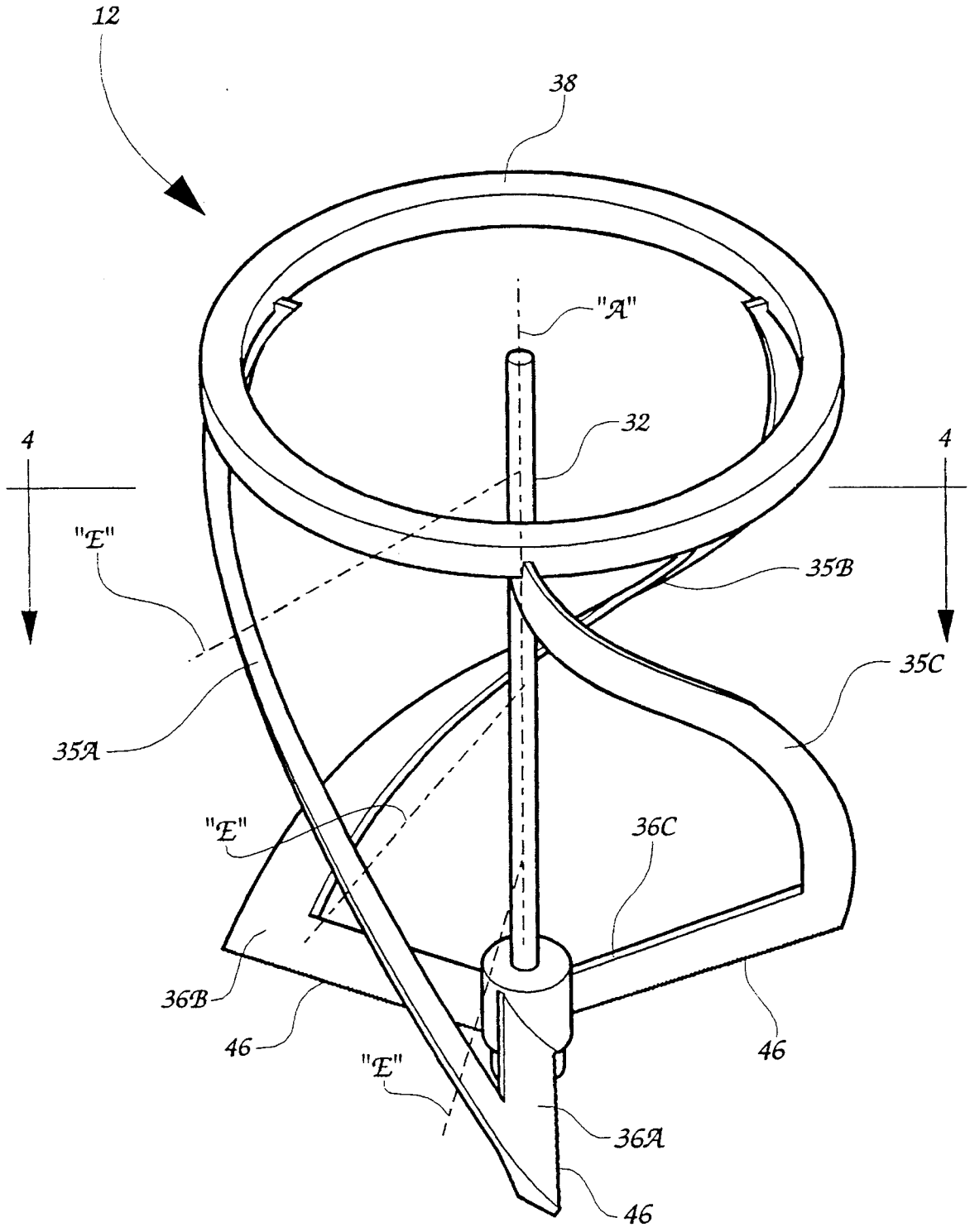
FIG. 3 is a perspective view of the beater assembly illustrating the helical construction of the mixer blades.
Figure 4:
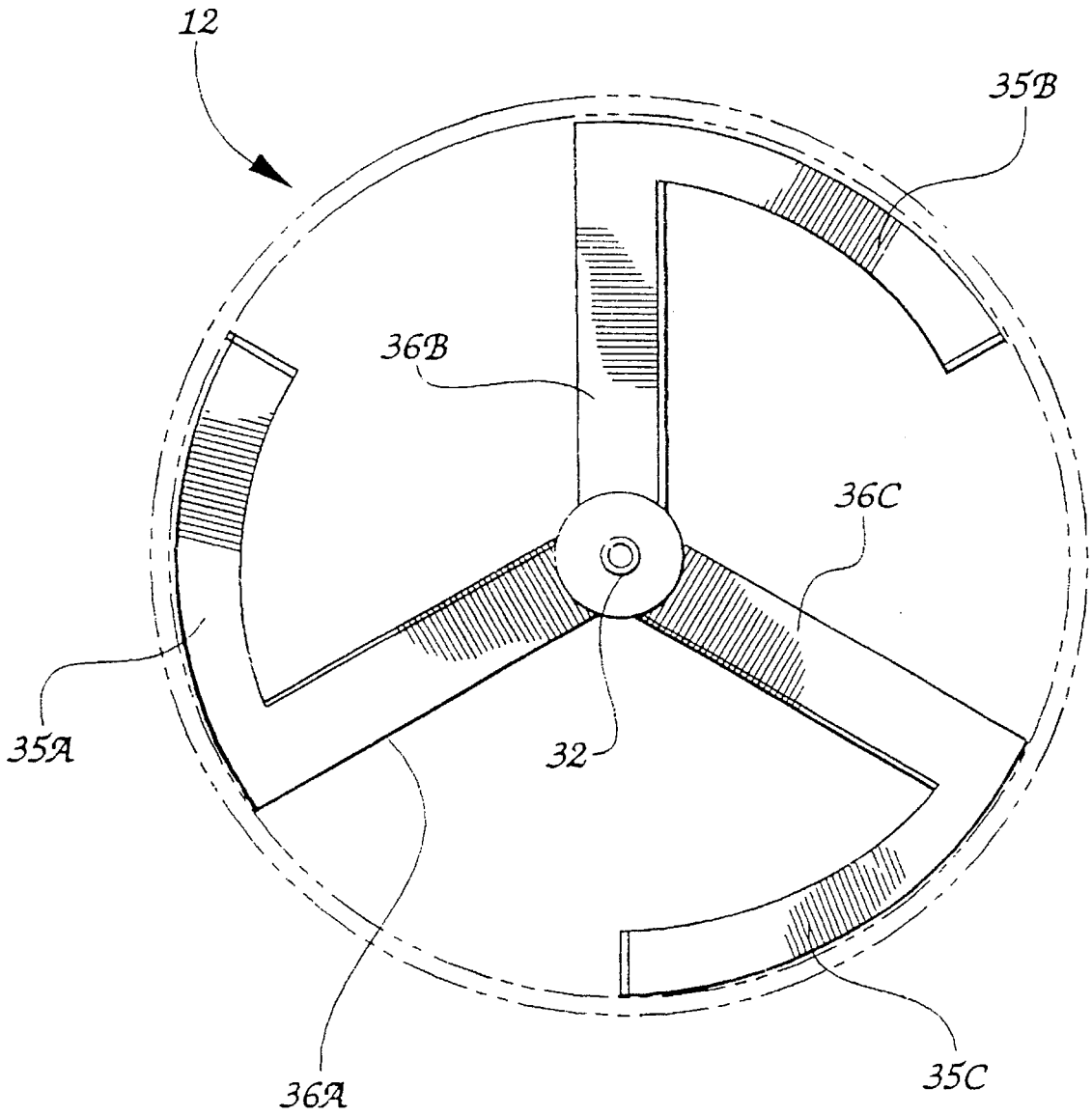
FIG. 4 is a cross-sectional view taken substantially along line 4—4 of FIG. 3.

Referring to FIGS. 1, 3, and 4, the beater assembly 12 is carried by a vertical lift 31, and includes a rotatable drive shaft 32 operatively connected to several helically extending mixer blades 35. The drive shaft 32 and mixer blades 35A, 35B, and 35C are centrally positioned within the vessel 11 during mixing. Preferably, the beater assembly 12 includes three mixer blades 35A, 35B, and 35C. In alternative embodiments, the beater assembly 12 may include only two blades 35, or between 4 and 6 blades 35 depending upon the diameter of the vessel 11.

As best shown in FIG. 3, respective bottom ends of the mixer blades 35A, 35B, and 35C are connected to arms 36A, 36B, and 36C extending outwardly from the base of the drive shaft 32. The top ends of the mixer blades 35A, 35B, and 35C are connected to an annular support hoop 38. The support hoop 38 has a diameter slightly less than the diameter of the vessel inner walls 16 to permit complete insertion of the blades 35A, 35B, and 35C into the vessel 11 for mixing. Preferably, the lid 17 of the vessel 11 includes a shaft opening 41 with a teflon sealer for receiving the drive shaft 32 into the vessel 11. The lift 31 serves to vertically position the mixer blades 35A, 35B, and 35C into and out of a mixing position within the vessel 11.

A hydraulic motor 42 is supported by the lift 31 and connected to a top portion of the drive shaft 32 outside of the vessel 11 for rotating the drive shaft 32 and mixer blades 35A, 35B, and 35C relative to the vessel 11. Depending upon the consistency of the materials being mixed, the motor 42 rotates the drive shaft 32 and mixer blades 35A, 35B, and 35C from between 0 and 100 rpm. In an alternative embodiment of the mixer 10, an electric motor or mechanical means may be used for actuating the drive shaft 32.

The support hoop 38 controls the inward and outward deflection of the mixer blades 35A, 35B, and 35C as they rotate within the vessel 11 during mixing. The support hoop 38 further acts to uniformly distribute the materials load throughout each of the arms 36A, 36B, and 36C. Thus, the load of a relatively heavy mass of materials acting on one arm 36A will be transferred through the mixer blade 35A and into the hoop 38 where it is evenly distributed and transferred back to the arms 36B and 36C through the blades 35B and 35C.

THE MIXER BLADES 35A, 35B, and 35C

As best shown in FIGS. 3 and 4, each mixer blade 35A–35C extends vertically in a true helical path between the arms 36A, 36B, and 36C of the drive shaft 32 and the annular hoop 38 such that a straight edge "E" laid at any position along a side surface of the blade 35A–35C extends directly through its axis of rotation "A". Thus, the angle of the blade side relative to the vessel inner walls 16 remains constant throughout each point on the blade 35A–35C.

Preferably, the dimension of the blade side surface is about one-tenth of the diameter of the vessel 11. Respective outer edges of the mixer blades 35A–35C follow the interior walls of a notional cylinder having a diameter equal to the diameter of the hoop 38. The mixer blades 35A–35C are preferably formed of metal.

As a result of the true helical blade construction, a single rotation of the beater assembly 12 in a clockwise direction operates to effectively and efficiently pump the materials contained in the vessel 11 from the top of the vessel 11 to the bottom of the vessel 11 during mixing, while simultaneously moving the materials inwardly and outwardly towards and away from the axis of rotation "A". Thus, the materials in the vessel 11 are continually being turned over and transferred during mixing between a center portion of the vessel 11 and an outer portion of the vessel 11 to provide uniform mixing and cooling. Alternatively, rotation of the beater assembly 12 in a counterclockwise direction pumps the materials contained the vessel 11 from the bottom of the vessel 11 to the top of the vessel 11 during mixing.

To prevent materials from accumulating on the inner walls 16 of the vessel 11 during mixing, one or more spring-loaded scrapers (not shown) are preferably attached to the outer edge of each of the mixer blades 35A–35C. The scrapers engage the inner walls 16 of the vessel 11 with sufficient force to effectively scrap away any materials collecting on the walls 16. Additional scrapers (not shown) may be provided on each of the arms 36A, 36B, and 36C of the drive shaft 32 to scrap away any materials accumulating on the bottom wall 15 of the vessel 11 during mixing. The bottom edges of the arms 36A, 36B, and 36C may include teeth 46 for facilitating penetration of the beater assembly 12 into the materials to be mixed.

In addition, a high-speed disperser blade 51 is preferably located within the vessel 11, and is operatively connected to a second drive shaft 52 and hydraulic motor 54. As shown in FIG. 1, the disperser blade 51 includes teeth 55 for shearing and mixing finer materials contained in the vessel 11. The drive shaft 52 of the disperser blade 51 extends downwardly through the lid 17 of the vessel 11, and within the annular hoop 38 of the beater assembly 12 to position the disperser blade 51 into an unobstructed area between the first drive shaft 32 and the path of the helical mixer blades 35A–35C. Because the hoop 38 is not connected directly to the first drive shaft 32, the disperser blade 51 is unobstructed by the beater assembly 12, and remains in a fixed position relative to the first drive shaft 32 during mixing. Preferably, the disperser blade 51 rotates at between 0 and 800 rpm.

In an alternative embodiment of the mixer (not shown), the arms of the drive shaft are located at a top end of the beater assembly with the annular support hoop being located at the bottom end of the beater assembly. According to this embodiment, the mixer does not include a disperser blade.

A mixer is described above. Various details of the invention may be changed without departing from its scope. Furthermore, the foregoing description of the preferred embodiment of the invention is provided for the purpose of illustration only and not for the purpose of limitation—the invention being defined by the claims.

I claim:

1. A mixer, comprising:

(a) a vessel for receiving materials to be mixed, and having cylindrical inner walls;

(b) a beater assembly rotatably mounted and centrally disposed within said vessel, and comprising:

i. an elongate drive shaft including a plurality of radially-extending support arms connected to a base end thereof;

ii. and a plurality of helically extending mixer blades connected at respective bottom ends thereof to the support arms of said drive shah for rotational movement about an axis defined by the drive shaft, the mixer blades cooperating upon a single rotation of said beater assembly to move materials residing immediately adjacent to the inner walls of the vessel inwardly towards the axis of rotation, and to simultaneously move materials residing near the axis of rotation outwardly towards the inner walls of the vessel, whereby the materials in the vessel are continually transferred during mixing between a center portion of the vessel and an outer portion of the vessel for uniform mixing and cooling of the materials;

iii. an annular support hoop attached to respective top ends of the mixer blades for controlling the inward and outward deflection of the mixer blades during mixing, and cooperating with said support arms to define an unobstructed area extending radially outwardly from the drive shaft to a circular path defined by said mixer blades during mixing, and axially along the length of said drive shaft between top and bottom ends of said blades;

iv. said mixer blades being supported entirely by said hoop and said arms;

(c) a disperser blade rotatably mounted on a second drive shaft received within said hoop, and extending downwardly into the unobstructed area of the beater assembly shearing and mixing relatively fine materials contained in said vessel;

(d) first and second motor means for rotating the respective first and second drive shafts.

2. A mixer according to claim 1, and comprising a vertical lift mounted outside of said vessel and connected to the drive shaft of said beater assembly for lowering the mixer blades into said vessel, and for lifting the mixer blades out of said vessel.

3. A mixer according to claim 1, wherein the arms of said beater assembly include teeth for engaging and breaking-up the materials contained in said vessel.

4. A mixer according to claim 1, and including a cooling jacket surrounding outer walls of said vessel for cooling the materials contained in said vessel during mixing.

5. A mixer according to claim 4, and including an inlet port formed in the jacket for receiving a cooling fluid.

6. A mixer according to claim 1, wherein said vessel includes a discharge opening for discharging the materials contained in said vessel after mixing.

7. A mixer according to claim 6, and including a control valve located at said discharge opening for controlling the flow of materials outwardly through said discharge opening.

8. A mixer according to claim 1, wherein said vessel includes a lid removably sealed to a top end of the vessel.

9. A mixer according to claim 8, and including a sight glass window formed in said lid for viewing of the materials contained in said vessel during mixing.

10. A mixer according to claim 8, and including a vessel port formed in the lid for receiving a second material into the vessel.

11. A mixer according to claim 1, and including a support carriage for locating the vessel on a supporting surface.

12. A mixer according to claim 11, wherein said carriage includes a plurality of wheels for transport of said vessel on the supporting surface.

* * * * *